US007819274B2

(12) United States Patent
Fripps

(10) Patent No.: US 7,819,274 B2
(45) Date of Patent: Oct. 26, 2010

(54) PORTABLE WATERING STATION

(76) Inventor: Anthony Fripps, 1301 E. Mount Pleasant Ave., Philadelphia, PA (US) 19150-2009

( * ) Notice: Subject to any disclaimer, the term of this patent is extended or adjusted under 35 U.S.C. 154(b) by 803 days.

(21) Appl. No.: 11/818,390

(22) Filed: Jun. 14, 2007

(65) Prior Publication Data

US 2007/0241116 A1 Oct. 18, 2007

Related U.S. Application Data

(60) Continuation-in-part of application No. 10/827,755, filed on Apr. 20, 2004, now abandoned, which is a division of application No. 10/274,323, filed on Oct. 18, 2002, now Pat. No. 6,776,303.

(60) Provisional application No. 60/921,518, filed on Apr. 3, 2007.

(51) Int. Cl.

| | |
|---|---|
| ***A47G 19/22*** | (2006.01) |
| ***B65D 6/40*** | (2006.01) |
| ***B65D 90/12*** | (2006.01) |
| *B65D 25/20* | (2006.01) |

(52) U.S. Cl. ..... 220/603; 220/565; 220/630; 220/634; 220/705; 220/714

(58) Field of Classification Search ..... 220/603, 220/565, 705, 714, 630, 636, 634
See application file for complete search history.

(56) References Cited

U.S. PATENT DOCUMENTS

| | | | | |
|---|---|---|---|---|
| 2,034,868 | A * | 3/1936 | Henriksen | 248/500 |
| 3,831,209 | A | 8/1974 | Clingman | |
| 5,115,939 | A * | 5/1992 | Porter | 220/705 |
| 5,560,513 | A * | 10/1996 | Jarrell | 220/705 |
| 5,690,679 | A | 11/1997 | Prentiss | |
| 6,439,418 | B1 * | 8/2002 | Immerman et al. | 220/630 |
| 6,491,183 | B1 * | 12/2002 | Huang | 220/629 |
| 6,571,976 | B1 * | 6/2003 | Sonnabend | 220/483 |
| 6,793,094 | B2 | 9/2004 | Turnbough | |
| 2003/0042265 | A1 * | 3/2003 | Hatch | 220/630 |
| 2004/0026428 | A1 * | 2/2004 | Dupras et al. | 220/565 |
| 2005/0056652 | A1 * | 3/2005 | Cezeaux | 220/709 |
| 2005/0061822 | A1 * | 3/2005 | Naesje | 220/705 |
| 2006/0054629 | A1 * | 3/2006 | Ronn et al. | 220/705 |

* cited by examiner

*Primary Examiner*—Anthony Stashick
*Assistant Examiner*—Niki M Eloshway
(74) *Attorney, Agent, or Firm*—Michael Crilly, Esquire

(57) ABSTRACT

A device facilitating consumption of a liquid during athletic activities or the like is presented. The invention includes a closed reservoir disposed between a base plate and a rigid outer tube having a flexible inner tube therein. The base plate is flexible, bendable, or deformable in a resilient fashion so as to allow the invention to tilt with use. The flexible inner tube allows a user to drink from the closed reservoir. The rigid outer tube supports the smaller flexible inner tube and allows a user to easily grasp the invention during use. The combination of rigid outer and flexible inner tubes allows a user to drink from the present invention in an upright or nearly upright position. In some embodiments, the base plate may include a peripheral region which is upwardly disposed. The height of the peripheral region may be sufficient so as to form an open reservoir capable of holding cold or heat packs so as to thermally condition liquid within the closed reservoir. Embodiments of the present invention are self righting and/or resist tip over.

17 Claims, 7 Drawing Sheets

PORTABLE WATERING STATION

CROSS REFERENCE TO RELATED APPLICATIONS

This application is a continuation-in-part of U.S. patent application Ser. No. 10/827,755 filed Apr. 20, 2004, now abandoned which is a divisional of U.S. patent application Ser. No. 10/274,323 filed Oct. 18, 2002, now U.S. Pat. No. 6,776,303, and further claims the benefit of U.S. Provisional Application Ser. No. 60/921,518 filed Apr. 3, 2007. The subject matter of the prior applications is incorporated in its entirety herein by reference thereto.

FEDERALLY SPONSORED RESEARCH AND DEVELOPMENT

None.

BACKGROUND OF THE INVENTION

1. Field of the Invention

The present invention generally relates to a device facilitating consumption of a liquid during athletic activities or the like. Specifically, the invention includes a reservoir, capable of holding a potable liquid, disposed between a base and a rigid outer tube having a flexible inner tube therein. The base element is flexible, bendable, or deformable in a resilient fashion so as to allow the invention to tilt with use. The flexible inner tube enables a user to drink from the reservoir. The rigid outer tube supports the smaller flexible inner tube and allows the invention to be easily grasped during use. The combination of rigid outer and flexible inner tubes facilitates the consumption of a liquid from the present invention while the user is in an upright or nearly upright position.

2. Background

A large variety of sports bottles are presently available for use during athletic activities or the like. Many devices are designed to be easily carried during use and discarded in an uncontrolled fashion after use. Bottle designs limit the quantity of liquid available to a user, complicate retrieval, and preclude cooling and heating of a liquid therein without limiting the volume of potable liquid. Furthermore, designs require the user to bend, kneel, or stoop to effect retrieval and/or use, thereby distracting the user from the event at hand.

It may be appreciated, therefore, that there remains a need for further advancements and improvements thus enabling the consumption of a liquid during athletic activities.

Accordingly, what is required is a device that minimizes bending, kneeling, stooping, and other physical accommodations required to consume a liquid during athletic activities.

What is also required is a device capable of holding and easily dispensing more liquid than portable, hand-held bottles.

What is further required is a device capable of cooling or heating a potable liquid without restricting the volume of liquid held therein.

SUMMARY OF THE INVENTION

An object of the present invention is to provide a device that minimizes the bending, kneeling, stooping, and other physical accommodations required to consume a liquid during athletic activities.

Another object of the present invention is to provide a device capable of holding and easily dispensing more liquid than hand-held bottles.

A further object of the present invention is to provide a device capable of cooling or heating a potable liquid without restricting the volume of liquid stored therein.

The present invention includes a base plate of generally planar extent, a rigid outer tube, a flexible inner tube disposed within and along the rigid outer tube, a closed reservoir capable of holding a liquid without spillage disposed between and attached to the base plate and rigid outer tube, and a plug attached to and removal from the closed reservoir. The base plate is composed of a flexible, bendable, or deformable material which is resilient having lateral extents greater than the closed reservoir to ensure the stability of the watering station. Base plate and closed reservoir are preferred to be circular shaped. The flexible inner tube communicates with the closed reservoir and extends beyond the outer tube opposite of the closed reservoir. The flexible inner tube and rigid outer tube have lateral extents less than the closed reservoir. The flexible inner tube may intermittently contact the rigid outer tube. In some embodiments, the closed reservoir may be composed of a shell attached to the base plate so as to form a cavity there between. Embodiments of the present invention resist tip over and/or are self righting.

In alternate embodiments, a grip is disposed about the rigid outer tube to facilitate retrievable. It is preferred that the grip be positioned along the rigid outer tube within one arm length of the user to facilitate retrieval and use of the invention. Likewise, it is preferred for the rigid outer tube to be sufficiently long so as to end at least as high as the waistline of the user.

In preferred embodiments, the closed reservoir includes a coupler which traverses and is attached to the shell and rigid outer tube. The coupler is disposed between and attached to an upper fitting and a lower fitting. The upper fitting is attached to the flexible inner tube and the lower fitting is attached to a tube within the reservoir. Thereafter, the tube may be attached to a check valve.

In yet other embodiments, the base plate may include a plurality of openings disposed about the closed reservoir. Openings may be arranged in a pattern that allows the base plate to be flexible when otherwise composed of a rigid material.

In still other embodiments, the base plate may include a peripheral region which is either upwardly or downwardly disposed. The height of the peripheral region may be sufficient so as to form an open reservoir capable of holding ice or a heated material so as to cool or heat liquid within the reservoir.

Two advantages are offered by the present invention. The invention minimizes the suction required to draw liquid from the reservoir by minimizing the diameter of the flexible inner tube without compromising the rigidity and handling provided by the rigid outer tube. The invention maximizes stability by placing the reservoir and its corresponding mass directly in contact with the surface upon which it rests.

BRIEF DESCRIPTION OF THE DRAWINGS

The invention will now be described in more detail, by way of example only, with reference to the accompanying drawings, in which.

REFERENCE NUMERALS

Figure 1:
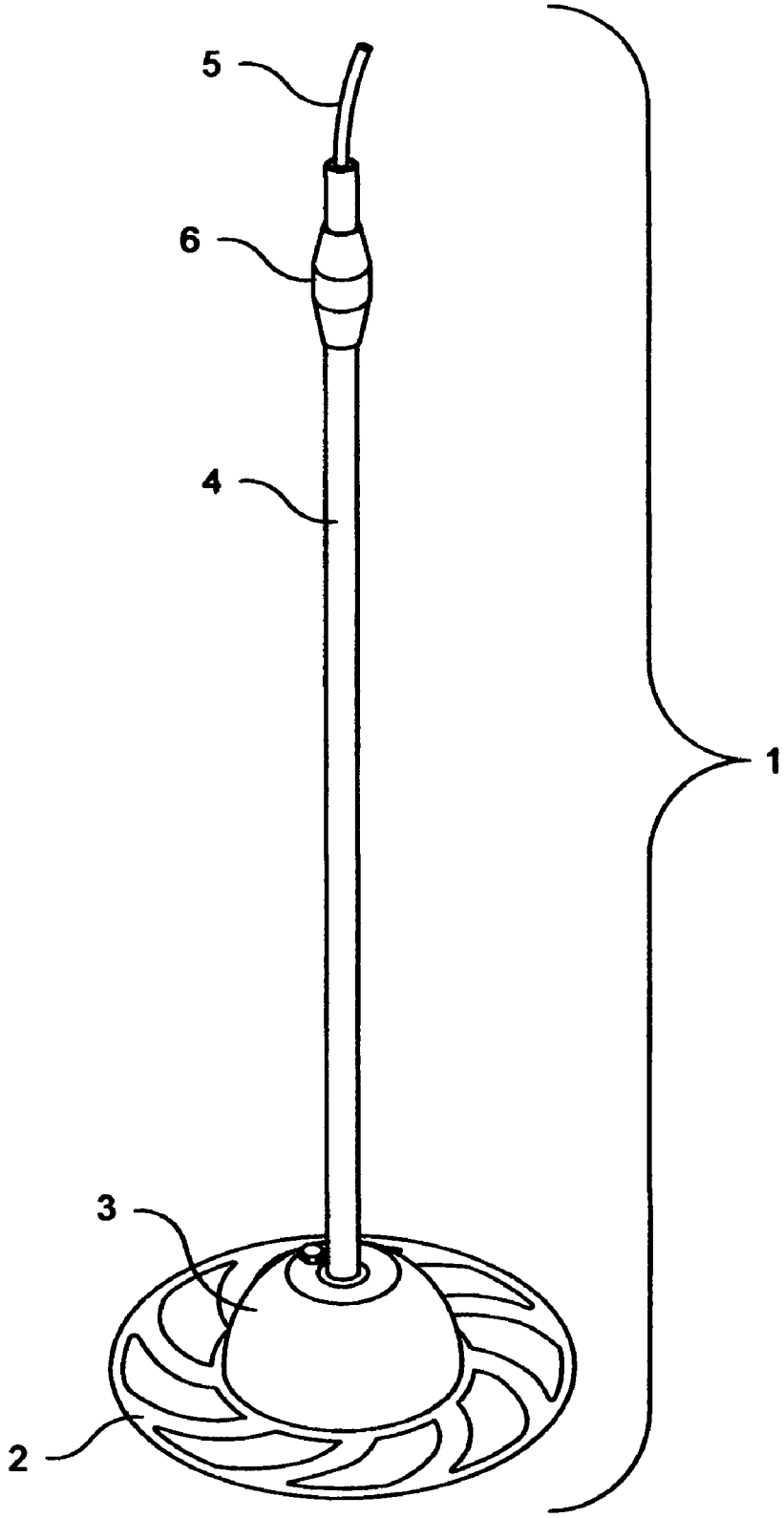
FIG. 1 is a perspective view showing one embodiment of the present invention including base plate, closed reservoir, rigid outer tube, flexible inner tube, and optional grip.

1 Watering Station
2 Base plate
15 Flexible tube
16 Nut
3 Closed reservoir
4 Rigid outer tube
5 Flexible inner tube
6 Grip
7 User
8 Surface
9 Opening
10 Shell
11 Coupler
12 Upper fitting
13 Lower fitting
14 Check valve
17 Cylindrical end
18 Barbed end
19 Barbed end
20 Second end
21 Bushing
22 Plug
23 Peripheral region
24 Peripheral region
25 Open reservoir
26 Height
27 Cavity
28 Flange

DESCRIPTION OF THE INVENTION

The present invention relates to a watering station 1 for storing and dispensing a potable liquid. FIGS. 1-7 describe several exemplary embodiments of the present invention and variations thereof.

Referring now to FIG. 1, the watering station 1 includes a generally planar base plate 2, a closed reservoir 3 attached to the base plate 2, a rigid outer tube 4 disposed in a generally vertical arrangement above the closed reservoir 3 and attached thereto, a flexible inner tube 5 disposed within and along the rigid outer tube 4, and an optional grip 6 disposed along the exterior surface of the rigid outer tube 4. Attachment of the closed reservoir 3 and base plate 2 at one end of the rigid outer tube 4 provides a low center of gravity thus ensuring the stability of the device against tip over and allowing the device to be self righting in some embodiments.

The base plate 2, closed reservoir 3, rigid outer tube 4, and grip 6 may be composed of a variety of impact resistant materials including metals, plastics (i.e., polycarbonates, ABS, and PVC), and composites. Furthermore, the closed reservoir 3 may be composed of materials with insulative properties.

The base plate 2 is preferred to be composed of a semi-rigid, flexible or resilient material, non-limiting examples including plastics, rubbers, and elastomers. The base plate 2 may be fabricated from sheet material having a constant thickness which is milled or machined about its perimeter to a specific shape. Exemplary perimeter shapes include circles, ellipses, rectangles, and squares.

The base plate 2 has lateral extents which are greater than that of the closed reservoir 3 so as to extend beyond the closed reservoir 3, as represented in FIGS. 1-3 and 5-7. The lateral dimensions of the base plate 2 directly influence the stability and tip over resistance of the watering station 1. For example, stability and tip over resistance increase with corresponding increases in the diameter or length and width of the base plate 2. As a general rule, stability and tip over resistance increase with the ratio of the lateral extents of the base plate 2 over those of the closed reservoir 3.

Figure 2:
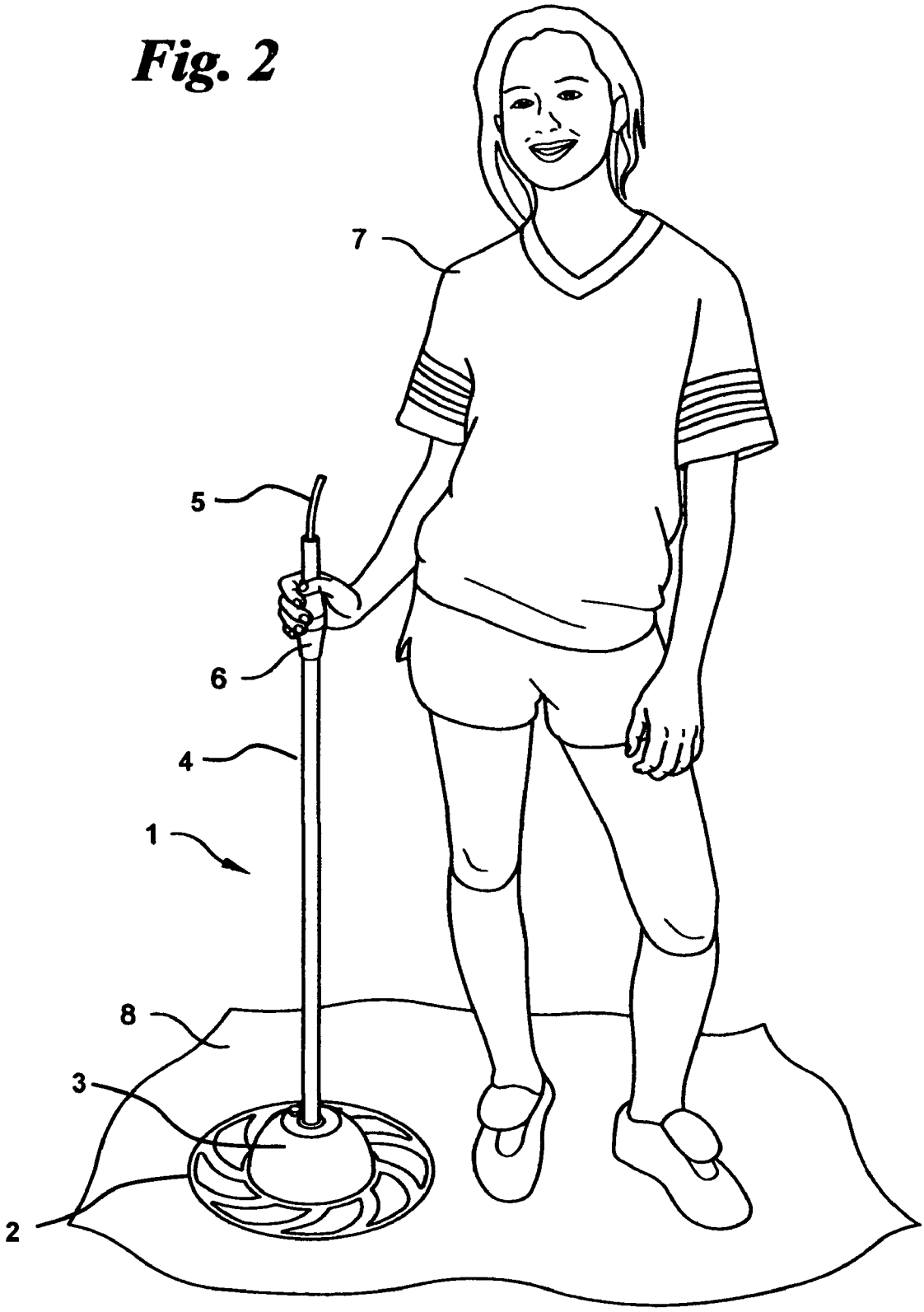
FIG. 2 is a view of the embodiment from FIG. 1 showing a user grasping a grip attached about the vertically disposed rigid outer tube.

The rigid outer tube 4 may be fabricated from a right-circular cylinder having a channel or opening along its length. In preferred embodiments, the rigid outer tube 4 should be sufficiently long so as to end at least as high as the waist of the user 7, as represented in FIG. 2. This arrangement allows the user 7 to easily grasp and hold the watering station 1 during use.

The flexible inner tube 5 is composed of flexible polymer, non-limiting examples including polyethylene and polypropylene compositions. The flexible inner tube 5 should be at least as long as the rigid outer tube 4 so as to communicate with the closed reservoir 3 and traverse the length of the rigid outer tube 4. In preferred embodiments, the flexible inner tube 5 should extend beyond the top of the rigid inner tube 4, as shown in FIG. 2, so as to reduce the distance between the mouth of a user 7 and end of the flexible inner tube 5. The user 7 drinks liquid from the watering station 1 by inducing a vacuum at the open end of the flexible inner tube 5 so as to draw liquid into and up the flexible inner tube 5.

Figure 4:
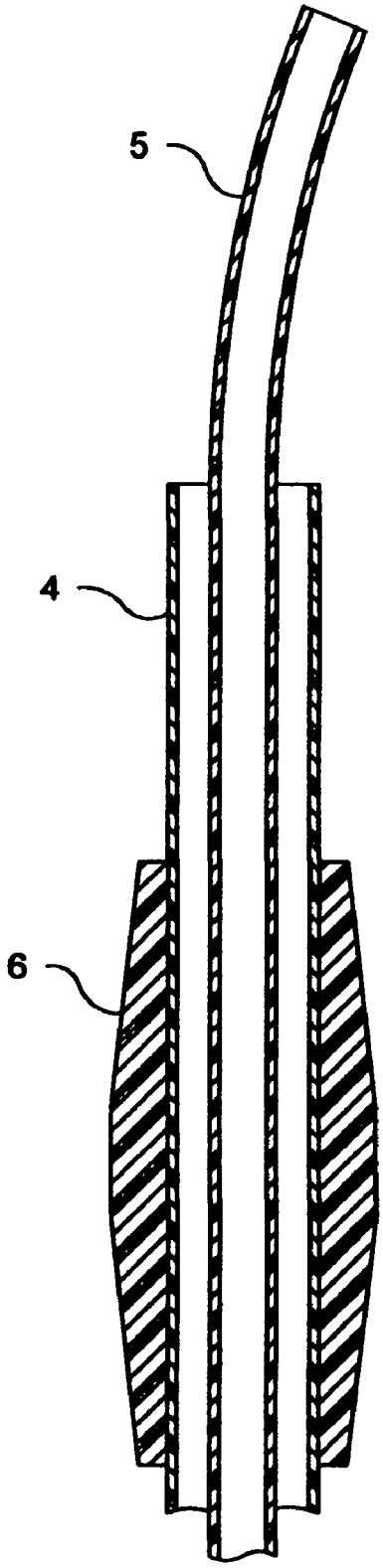
FIG. 4 is a section view of the flexible inner tube and rigid outer tube with a grip attached about the rigid outer tube.

Referring now to FIGS. 2 and 4, the watering station 1 is shown resting on a surface 8 and held by a user 7 along the grip 6. The grip 6 is a cylinder shaped element having an inner diameter sufficient to allow it to slide along the rigid outer tube 4. The grip 6 may include a variety of exterior profiles including preferred embodiments which compliment the shape of a hand. In preferred embodiments, the grip 6 is adhesively bonded to the rigid outer tube 4 and located so as to allow the user 7 to grasp it within a reach no more than one arm length. The grip 6 may be composed of a hard plastic, examples being polycarbonates, ABS and PVC, or a low-density compressible material, one example being polyurethane foam.

Figure 3:
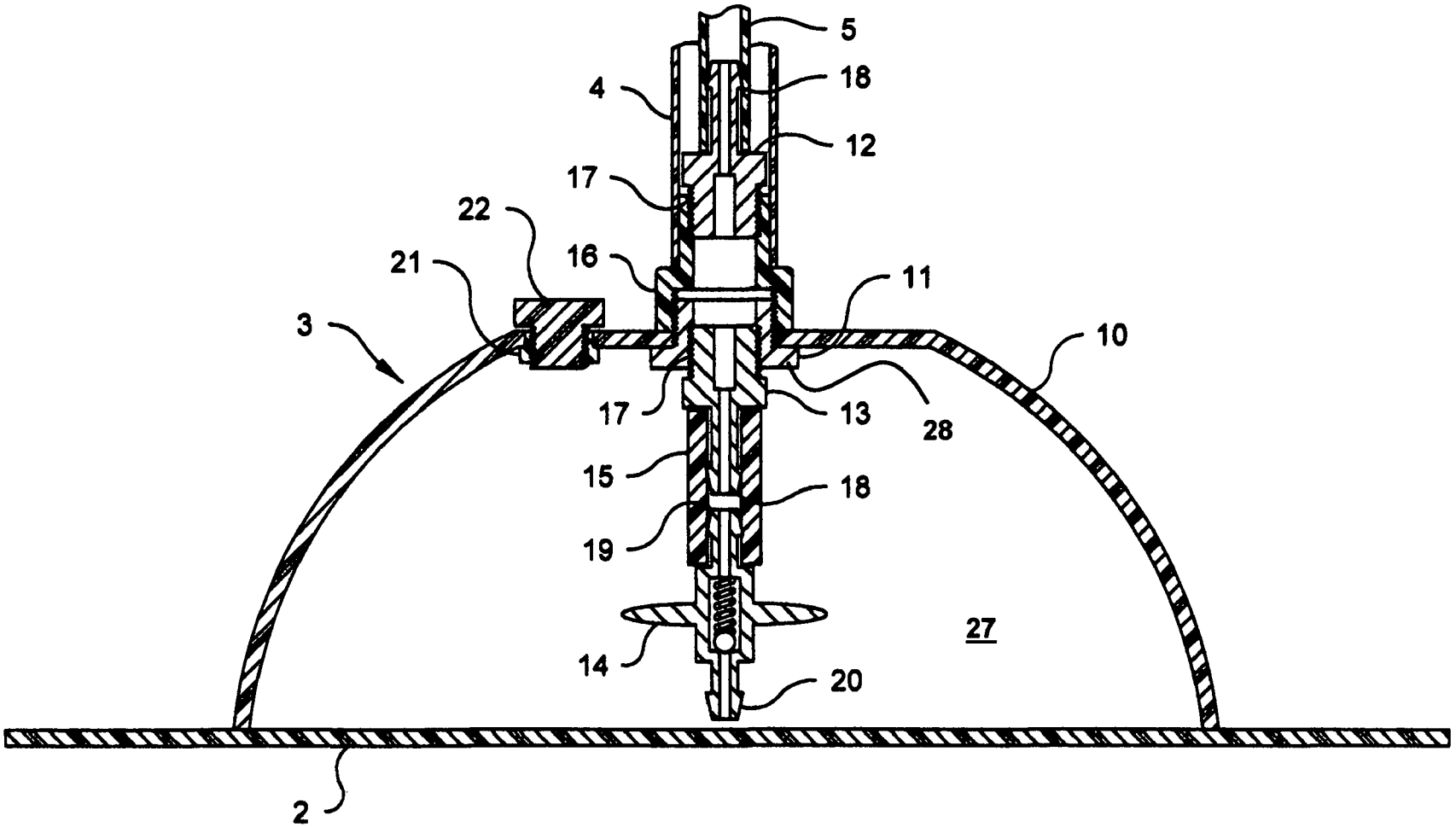
FIG. 3 is a section view of the reservoir from FIG. 1 showing attachment of a shell to the base plate to form the closed reservoir, a coupler to the shell, nut, and rigid outer tube, an upper fitting between nut and flexible inner tube, a lower fitting between the coupler and a tube, a check valve to the tube, and a bushing with plug to the shell.

Referring now to FIG. 3, one embodiment of the closed reservoir 3 may be constructed of a cup-shaped shell 10 adhesively bonded or ultrasonically welded to the base plate 2 to form a leak proof cavity 27 there between. The cavity 27 should be sufficiently voluminous so as to hold a liquid allowing a user 7 to drink two or more times. In other embodiments, the closed reservoir 3 may be composed of a closed container which is bonded or welded to the base plate 2 via techniques referenced above. The closed reservoir 3 may have a variety of shapes including circular, square, and rectangular designs.

An opening is provided along the closed reservoir 3, preferably at the top of the shell 10, to facilitate refill and the addition of ice. While a variety of plug 22 mechanisms are applicable to this opening, FIG. 3 shows a bushing 21 adhesively bonded to the shell within the cavity 27. The bushing 21 includes a threaded interior wall which compliments threads along the exterior of the plug 22. Both bushing 21 and plug 22 are preferred to be composed of a plastic material which provide a leak proof seal.

Communication of the flexible inner tube 5 to the closed reservoir 3 may include a variety of fixed arrangements. In its simplest form, the flexible inner tube 5 may traverse an opening within the shell 10. Referring again to FIG. 3, another exemplary embodiment includes a tube-shaped coupler 11 which traverses a hole at the top of the closed reservoir 3 opposite of the base plate 2. A flange 28 along and perpendicular to the coupler 11 contacts the inner surface of the shell 10 thereby providing a positive stop. The coupler 11 is threaded and/or adhesively bonded to the shell 10 via an epoxy or silicone-based adhesive to fix the coupler 11 to the shell 10 and to form a leak proof seal. A nut 16 is placed over the top of the coupler 11 so as to contact both coupler 11 and shell 10. The nut 16 is threaded onto the coupler 11 and adhesively bonded to the shell 10 via an epoxy or silicone-based adhesive. The nut 16 may be composed of a metal or plastic.

An upper fitting 12 and lower fitting 13 are thereafter attached about the coupler 11. Fittings 12, 13 include a cylindrical end 17 and a barbed end 18 disposed at opposite ends thereof. The cylindrical end 17 of the tube-shaped upper fitting 12 is threaded onto and adhesively bonded to the upper end of the nut 16. The cylindrical end 17 of the tube-shaped lower fitting 13 is threaded onto the interior side of the coupler 11, as represented in FIG. 3. The threaded attachment of fittings 12, 13 may include a layer of PTFE tape there between to provide a leak proof seal. Coupler 11, upper fitting 12, and lower fitting 13 may be composed of a hard plastic, one example being PVC, or metal, one example being brass.

The flexible inner tube 5 is attached to the upper fitting 12 by pressing one end thereof onto and over the barbed end 18. Likewise, a flexible tube 15, composed of a material identified above for the flexible inner tube 5, may be attached to the lower fitting 13 by pressing one end thereof onto and over the respective barbed end 18. This construction approach allows replacement of the flexible inner tube 5 when damaged or contaminated.

In preferred embodiments, a check valve 14 is desired along the length of the extraction tube to ensure liquid remains within the flexible inner tube 5 after first drawn therein. Referring again to FIG. 3, a check valve 14 is shown within the closed reservoir 3 and attached to the flexible tube 15. The flexible tube 15 is attached to the check valve 14 by pressing the free end of the flexible tube 15 onto and over the barbed end 19 of the check valve 14. The second end 20 of the check valve 14 may be barded to facilitate connection to other tubes within the closed reservoir 3. Likewise, it is possible for the check valve 14 to be attached in other configurations within or outside of the closed reservoir 3.

Referring again to FIG. 3, the rigid outer tube 4 is shown contacting and surrounding the end of the nut 16 projecting above the reservoir 3. In other embodiments, the rigid outer tube 4 may be directly connected to the coupler 11. In preferred embodiments, the rigid outer tube 4 is adhesively bonded to the nut 16 via an epoxy or silicone-based adhesive to provide a leak proof seal. In other embodiments, the rigid outer tube 4 may be disposed between coupler 11 and nut 16 so that the end of the rigid outer tube 4 directly contacts the upper surface of the flange 28 rather than the nut 16.

Figure 5:
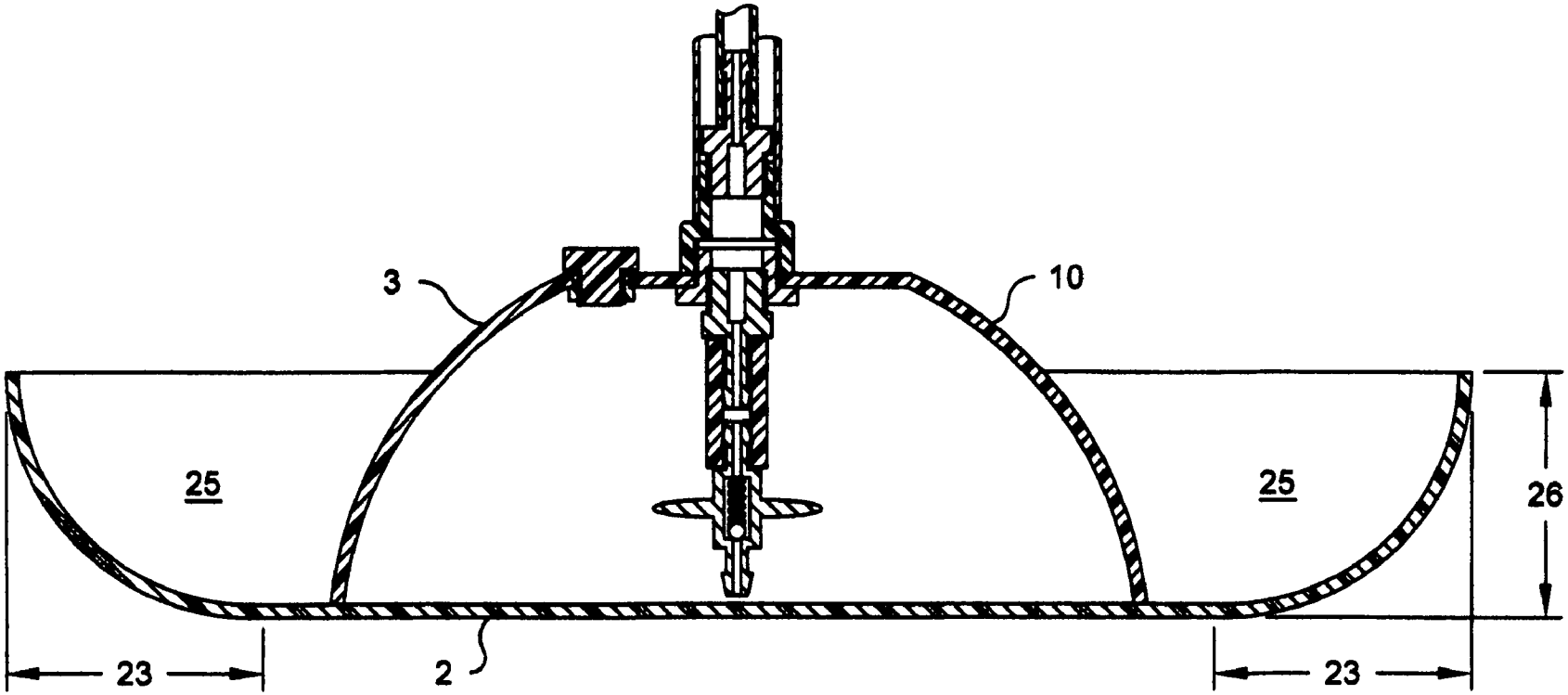
FIG. 5 is a section view of an alternate embodiment of the present invention having a base plate with a peripheral region disposed in an upward fashion adjacent to the perimeter of the base plate.
Figure 6:
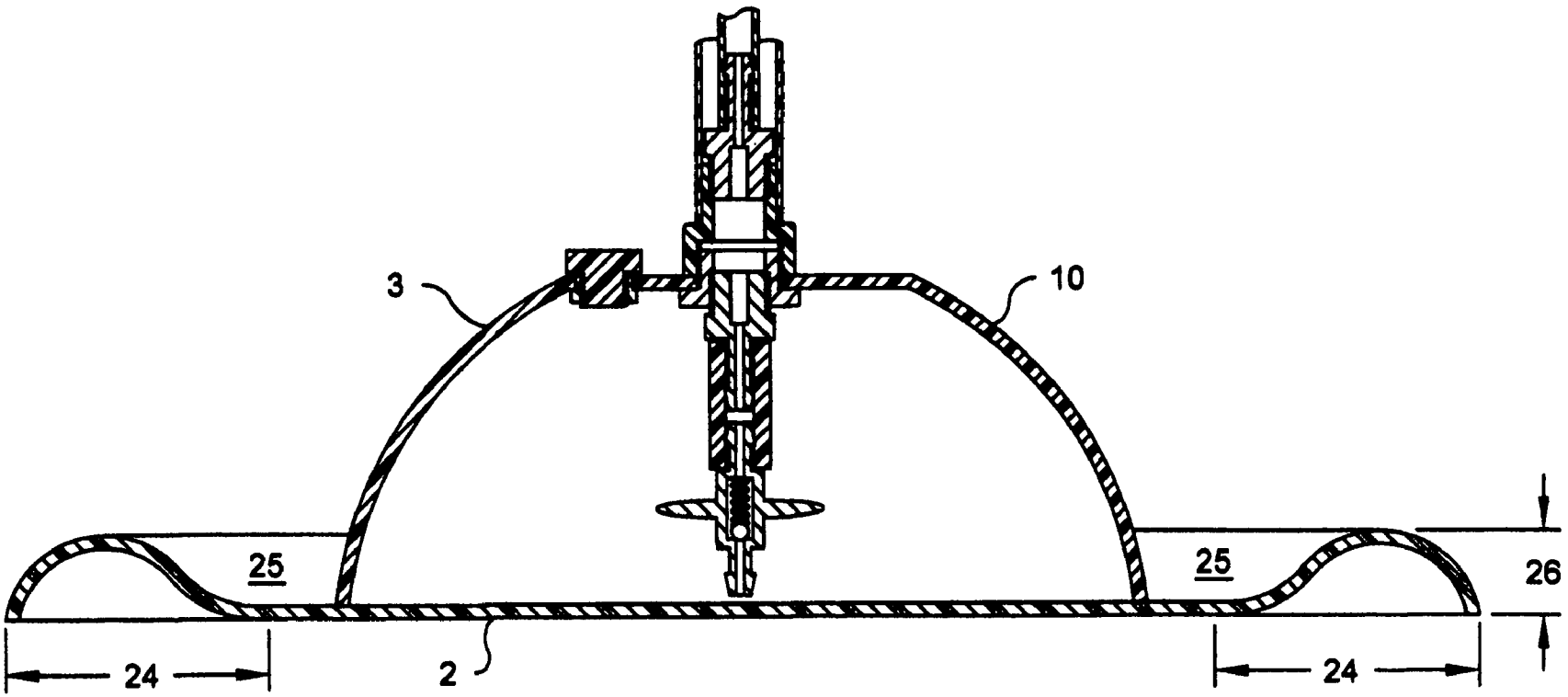
FIG. 6 is a section view of an alternate embodiment of the present invention having a base plate with a peripheral region disposed in a curved fashion adjacent to the perimeter of the base plate.

Referring now to FIGS. 5 and 6, the base plate 2 is shown having a peripheral region 23 and 24, respectively, which is shaped to form a structure of uniform design about the perimeter of the base plate 2. In FIG. 5, the peripheral region 23 is shown upwardly disposed so as to form a cup-shaped structure about the closed reservoir 3. In FIG. 6, the peripheral region 24 is shaped so as to form a hump-like structure of generally curvatious design whereby the edge or perimeter of the base plate 2 contacts the surface onto which the base plate 2 is placed. In other embodiments, the perimeter may be raised above the contact surface. The peripheral region 23 or 24 may be formed by heating the otherwise planar base plate 2 and pressing it onto a mold with the desired profile or directly molding the peripheral region 23 or 24 onto the base plate 2 via extrusion or injection techniques understood in the art.

In some embodiments, the height 26 of the peripheral region 23 or 24 should be sufficient so as to form an open reservoir 25 about the closed reservoir 3. For example, the peripheral region 23 or 24 may have a height 26, preferably at least as high as that of the closed reservoir 3, so as to allow the placement of ice, cold packs, hot packs, or the like thereon to either cool or heat liquid within the closed reservoir 3.

The alternate embodiments in FIGS. 5 and 6 allow placement and replacement of cooling and heating elements without accessing the closed reservoir 3 and avoid further displacement of liquid from the closed reservoir 3. Furthermore, the placement of cooling and heating elements about the periphery of the base plate 2 improves the stability of the watering station 1 by further reducing the center of gravity of the device.

Figure 7:
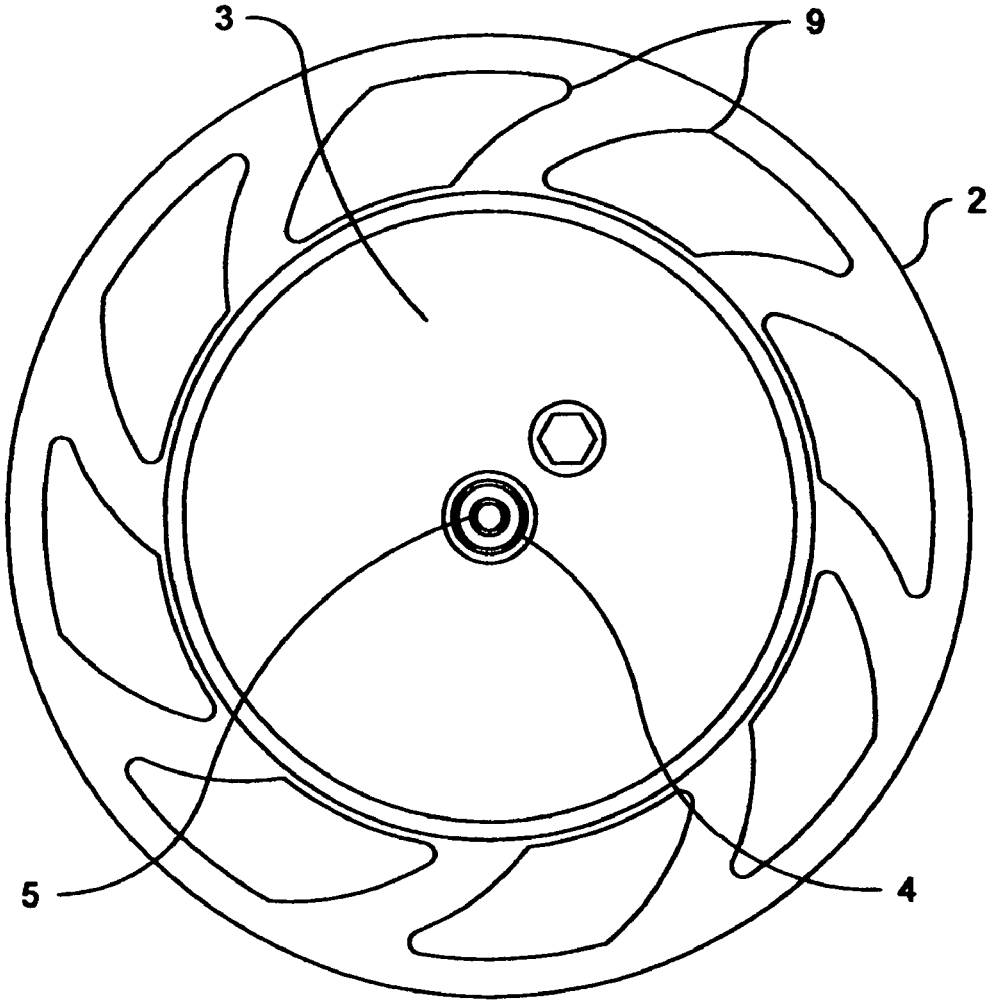
FIG. 7 is a top plan view of one embodiment of the present invention showing a plurality of openings disposed along the base plate about the closed reservoir.

Referring now to FIG. 7, the base plate 2 is shown having a plurality of openings 9 disposed along the base plate 2 adjacent to but not contacting the closed reservoir 3. Openings 9 are formed by milling, machining, or molding techniques understood in the art. Openings 9 may include a variety of shapes, including without limitation circles, parallelograms, ellipses, and the like. Openings 9 may be arranged in a variety of patterns along the base plate 2.

In some embodiments, openings 9 may reduce the weight or rigidity of the base plate 2 without compromising the structure thereof. In yet other embodiments, openings 9 may be arranged so as to allow flexure along the base plate 2 when composed of an otherwise rigid material without compromising the integrity of the element.

The description above indicates that a great degree of flexibility is offered in terms of the present invention. Although the invention has been described in considerable detail with reference to certain preferred versions thereof, other versions are possible. Therefore, the spirit and scope of the appended claims should not be limited to the description of the preferred versions contained herein.

What is claimed is:

1. A portable watering station comprising:

(a) a base plate of generally planar extent, said base plate comprised of a resilient material being flexible, bendable, or deformable;

(b) a rigid outer tube;

(c) a flexible inner tube disposed within and along said rigid outer tube;

(d) a closed reservoir disposed between and attached to said base plate and said rigid outer tube, said flexible inner tube communicating with said closed reservoir, said base plate with lateral extents greater than said closed reservoir, said flexible inner tube and said rigid outer tube with lateral extents less than said closed reservoir, said closed reservoir includes a coupler which traverses and is attached thereto, said coupler disposed between and attached to an upper fitting and a lower fitting, said upper fitting attached to said flexible inner tube and said lower fitting attached to a tube within said cavity, said rigid outer tube attached to said coupler; and (e) a plug removably attachable to an opening along said closed reservoir.

2. The portable watering station of claim 1, wherein said resilient material is comprised of a plastic, a rubber, or an elastomer.

3. The portable watering station of claim 1, wherein said flexible inner tube intermittently contacts said rigid outer tube.

4. The portable watering station of claim 1, further comprising:

(f) a grip disposed about said rigid outer tube.

5. The portable watering station of claim 4, wherein said grip is located along said rigid outer tube at most one arm length from a user.

6. The portable watering station of claim 1, wherein said rigid outer tube ends at least as high as the waistline of a user.

7. The portable watering station of claim 1, wherein said closed reservoir comprises a shell attached to said base plate with a cavity there between.

8. The portable watering station of claim 1, wherein said tube is attached to a check valve opposite of said lower fitting.

9. The portable watering station of claim 1, wherein said base plate is circular shaped.

10. The portable watering station of claim 1, wherein said closed reservoir is circular shaped.

11. The portable watering station of claim 1, wherein said base plate having a plurality of openings thereon.

12. The portable watering station of claim 1, wherein said base plate having a peripheral region upwardly disposed adjacent to the edge of said base plate.

13. The portable watering station of claim 12, wherein said peripheral region forms an open reservoir about said closed reservoir.

14. The portable watering station of claim 1, wherein said base plate having a peripheral region curved to form a hump adjacent to the edge of said base plate.

15. The portable watering station of claim 14, wherein said peripheral region forms an open reservoir about said closed reservoir.

16. The portable watering station of claim 1, wherein said portable watering station is self righting.

17. The portable watering station of claim 1, wherein said portable water station resists tip over.

* * * * *